US005228515A

United States Patent [19]

Tran

[11] Patent Number: 5,228,515

[45] Date of Patent: Jul. 20, 1993

[54] MODULAR, COMPACT HEAT EXCHANGER

[76] Inventor: Hai H. Tran, 2407 McNeil, Wichita Falls, Tex. 76307

[21] Appl. No.: 922,747

[22] Filed: Jul. 31, 1992

[51] Int. Cl.[5] ..... F28D 9/00; F28D 9/02

[52] U.S. Cl. ..... 165/166; 165/76; 165/178

[58] Field of Search ..... 165/76, 166, 167, 178

[56] References Cited

U.S. PATENT DOCUMENTS

| | | | |
|---|---|---|---|
| 2,877,000 | 3/1959 | Person | 165/166 X |
| 2,959,400 | 11/1960 | Simpelaar | 165/166 |
| 3,847,211 | 11/1974 | Fischel et al. | 165/166 |
| 4,043,388 | 8/1977 | Zebuhr | 165/166 |
| 4,569,391 | 2/1986 | Hulswitt et al. | 165/166 |
| 4,688,631 | 8/1987 | Peze et al. | 165/166 |
| 4,724,902 | 2/1988 | Gross | 165/166 |
| 5,069,276 | 12/1991 | Seidel | 165/166 |

*Primary Examiner*—Allen J. Flanigan

*Attorney, Agent, or Firm*—Richard C. Litman

[57] ABSTRACT

A compact, modular heat exchanger is field assembled and supported solely on its associated piping system. Internally, it has stacked clamshell cells. The cells are enclosed to form an essentially cubic configuration by two inlet headers, two outlet headers, a top plate, and a bottom plate. A first fluid flows in the interior of all cells, from header to header, and a second fluid flows around, but not in, the cells, from and to its respective headers. Conical and tetrahedral embossments extend inwardly and outwardly from each clamshell section to provide standoffs preventing collapse of the cell and to space adjacent cells apart. Knockouts located within the headers facilitate pipe connections. An alternative embodiment include internal baffling to establish a counterflow pattern. Another alternative embodiment provides fluting of heat exchange surfaces instead of embossments.

6 Claims, 5 Drawing Sheets

MODULAR, COMPACT HEAT EXCHANGER

BACKGROUND OF THE INVENTION

1. Field of the Invention

The present invention relates to heat exchangers, and more particularly to a compact, modular heat exchanger supported on fluid conduits to which it is connected.

2. Description of the Prior Art

Liquid to liquid heat exchangers are used in many heating and cooling applications, and in many cases, are useful for individual heating and cooling appliances. In such cases, the heat exchange elements may be fairly small. However, commercial practice has not developed small, lightweight exchangers which are readily assembled and connected to piping systems. This may be because mass production lends itself to large production runs, allowing for few variations in size or capacity. With relatively few models, capacities, and configurations, it becomes necessary for a single model to serve in a wide range of applications, such a unit necessarily being larger than warranted for most applications. As such, the unit has relatively great weight and bulk. For most applications, therefore, the unit dwarfs the piping to which it is connected. Aside from being wasteful with regard to occupied space and cost, this bulk and mass require support structure, possibly including legs or suspension means, and ready access to a supporting environmental surface. Also, labor of installation would accordingly be increased.

In U.S. Pat. No. 4,569,391, issued on Feb. 11, 1986, Charles E. Hulswitt et al. present a compact heat exchanger essentially formed by a chamber having stacked parallel heat exchange plates and four headers attached thereto. This heat exchanger includes a series of parallel plates having embossments presenting a depression on one side of the plate and a corresponding protuberance on the opposite side of the plate.

The ability to be field installed is an important feature of the present invention. The heat exchanger of '391 is constructed such that ready field assembly is not readily accomplished. Also, the ingress angle of the pipe couplings causes the headers, if this device is furnished as a field installed kit, to require precise positioning during assembly. Furthermore, the lack of right angles or of parallel ingress and egress of pipe couplings makes for more complicated field assembly to a piping system.

In U.S. Pat. No. 4,099,928, issued to Per S. Norback on Jul. 11, 1978, a fabrication method is presented in which thin heat exchange sheet members are folded and fastened, as by soldering, to form an assembly segregating two flows of gaseous media such that heat is transferred from one flow to the other. Texturing for heat transfer in each heat exchange sheet is provided by fluting. Norback further discloses fluted heat exchange sheets, the fluting of two adjacent sheets running at an angle or bias to the fluting of the other sheet.

Neither of the above inventions and patents, taken either singly or in combination, is seen to describe the instant invention as claimed.

SUMMARY OF THE INVENTION

The heat exchanger of the present invention is field assembled from a series of modular cells defining fluid passages. Each cell is formed by joining a top shell member to a corresponding, mirror image bottom shell. The cells are stacked, and have embossments formed in each shell. Embossments alternately extend outwardly (toward an adjacent cell above or below) and inwardly (toward a corresponding embossment within the same cell). Outwardly facing embossments are aligned with cooperating embossments from an adjacent cell such that the embossments abut, thus spacing the cells apart. Inwardly facing embossments are aligned with cooperating inward embossments formed in the complementary shell, the cooperating embossments nearly abutting, such that each shell mutually supports its opposing shell so as to preclude cell collapse.

In an alternative embodiment, embossments are omitted in favor of fluted, or pleated, cell surfaces. The flutes of one cell surface run at an angle to those of the next cell, and also at an angle to those of the opposite surface of the same cell.

A selected number of cells is surrounded by, and therefore enclosed within, four headers and two plates. A first inlet header distributes a first fluid to flow throughout the heat exchanger to a first collection header. A second inlet header distributes a second fluid, of a different temperature, to flow throughout the heat exchanger to a second collection header.

The first fluid flows through the interior of all of the stacked cells, and the second fluid flows around the cells in the space left between aligned, outward embossments.

In another alternative embodiment, additional plates may be installed to direct fluid to flow along a long dimension around the cell exteriors instead of in a direction perpendicular to the long cell dimension that the fluid would ordinarily take. The fluids flowing inside the cells can thus be directed to flow opposite one another within the heat exchanger.

During assembly, the cells are first formed by joining two shells. A desired number of cells is stacked, with the open ends oriented similarly, so that fluid will enter all cells from a common inlet header, and will be discharged to a common collection header.

The respective headers are then attached. A top and a bottom plate are attached, completing the enclosure. Knockout panels are removed from the headers, and four pipes from a piping system are suitably connected. The heat exchanger is thereby enclosed, sealed, and is further supported on the four pipes to which it is attached.

The embossments are essentially conical or essentially tetrahedral, and open on a remaining side in either case. These configurations promote turbulence in the fluid flows. This turbulence strips away a boundary stratum of fluid which is defined along each shell surface, so that contact of the fluid with the solid surface is more intimate, heat thus transferring more quickly.

In an alternate embodiment, shell surface texturing to promote turbulence is provided by fluting, the fluting of a top shell running at an angle to the fluting of a bottom shell. Fluting between adjacent cells is run in biased fashion. Support opposing cell collapse and spacing apart of adjacent cells as provided by the arrangement utilizing embossments are therefore also provided.

Accordingly, it is a principal object of the invention to provide a heat exchanger having selectively variable height, modular construction.

It is another object of the invention to provide a compact heat exchanger capable of being supported on the piping system to which it is connected.

It is a further object of the invention to provide internal heat exchanger fluid conduits which resist collapse, as might otherwise occur during pressure surges.

Still another object of the invention is to provide internal heat exchanger fluid conduits which promote turbulence, thus disrupting fluid boundary layers.

A still further object of the invention is to provide headers having panels which are preformed and removable by hand tools to reveal openings corresponding to pipe configurations, thereby facilitating pipe connection.

Yet a further object of the invention is to provide a compact heat exchanger which avoids excessive resistance to fluid flow therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
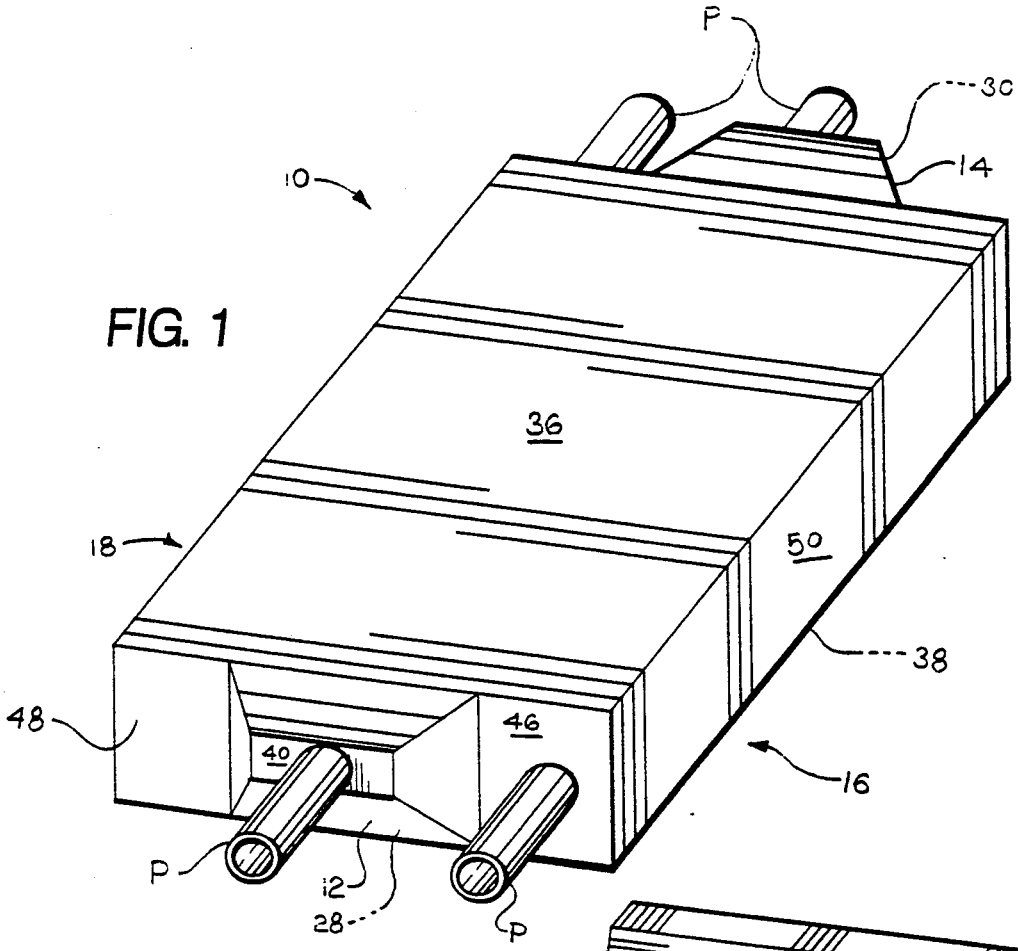
FIG. 1 is an isometric, environmental view of the novel heat exchanger.

The present invention, seen in FIG. 1 fully assembled and connected to piping P, comprises a field assembled modular heat exchanger 10 which is sufficiently small and lightweight as to be supported on the pipes P to which it is attached. A four pipe system P is connected to distribution and collection headers 12, 14 handling a first fluid A, and to distribution and collection headers 16, 18 handling a second fluid B.

Figure 2:
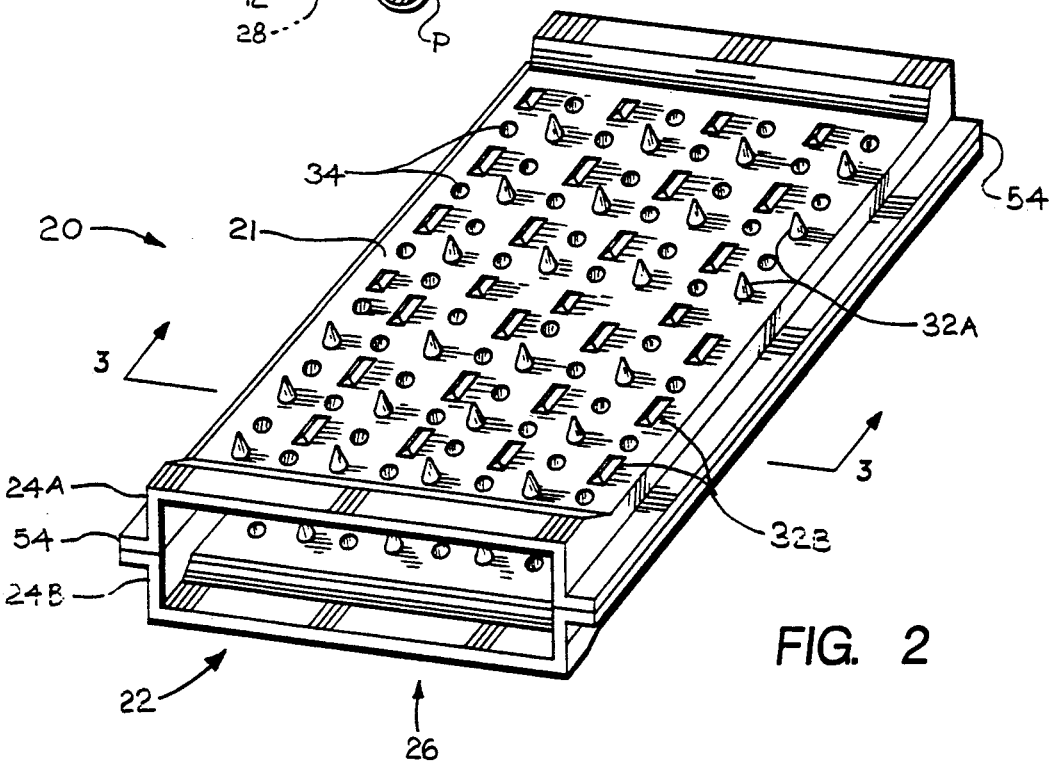
FIG. 2 is an isometric view of a single cell.

Referring now to FIG. 2, a modular cell 20 defines a fluid passage 22 therein through which a first fluid A flows. A second fluid B, having a different temperature, passes over, between, and beneath these cells 20, fluid flow patterns being shown in FIG. 5.

The cells 20 are fluid-tight, so that the two fluids A, B are segregated from one another. Each cell 20 is formed by joining, as by soldering or TIG welding, a top shell member 24A to a corresponding, mirror image bottom shell member 24B. The cell 20 has a wide mouth 26 at both inlet and outlet ends, the mouths 26 providing communication with the header chambers 28, 30.

Figure 4:
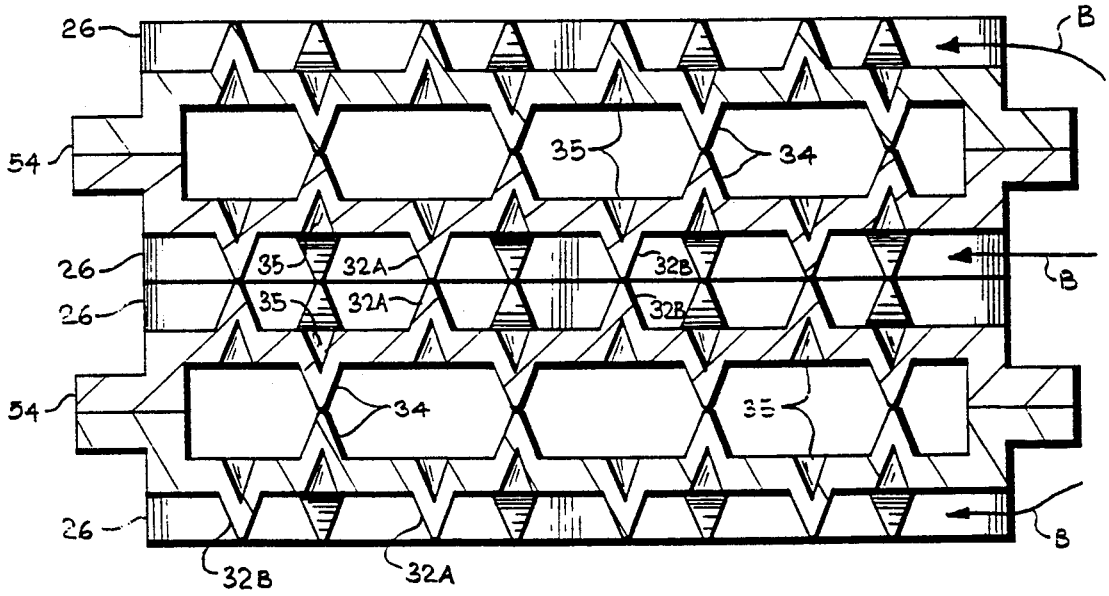
FIG. 4 is a cross sectional view of two stacked cells, also taken along line 3—3 of FIG. 2.
Figure 5:
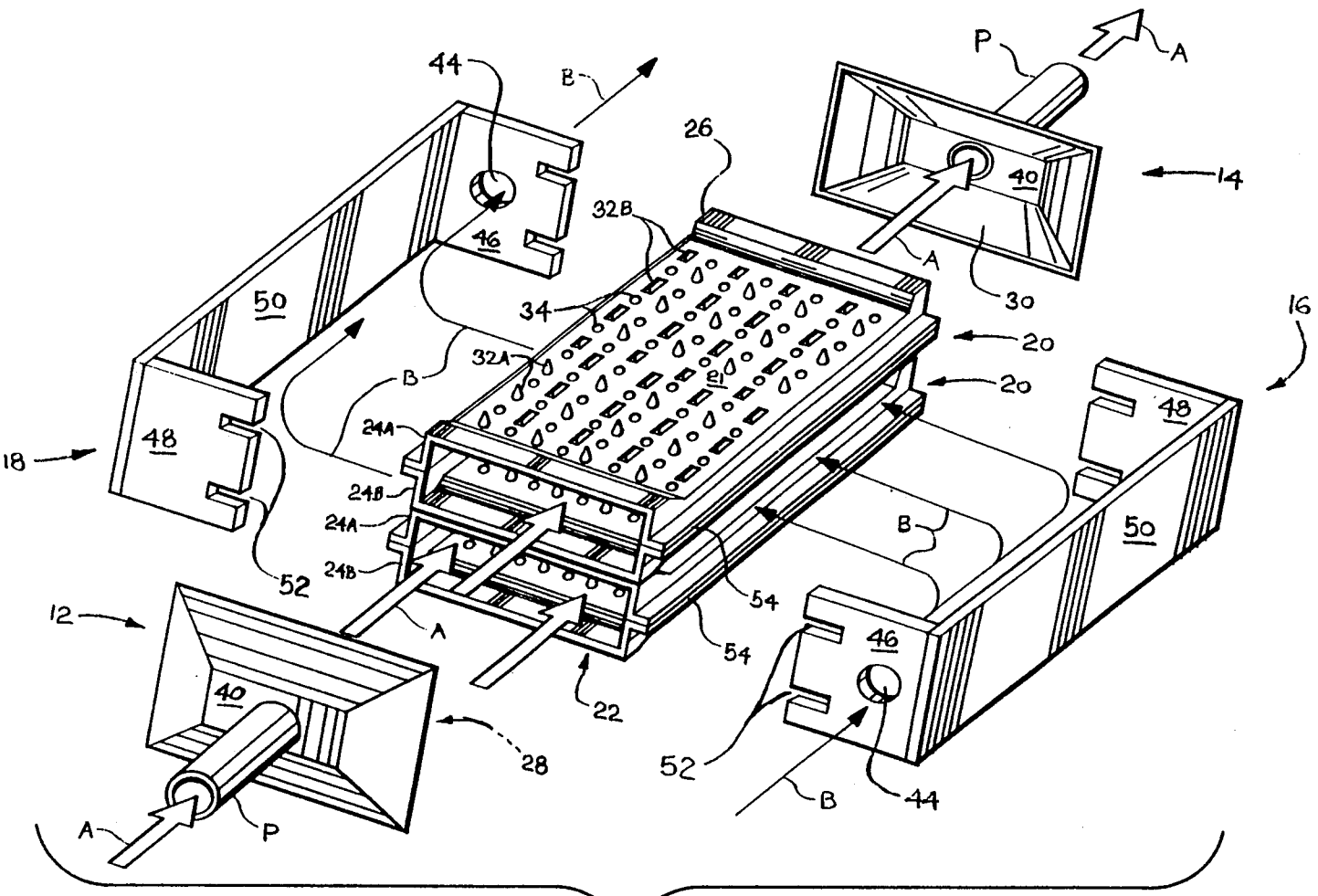
FIG. 5 is an exploded isometric view of the invention with top and bottom plates omitted for clarity, and including arrows indicating fluid flow.
Figure 8:
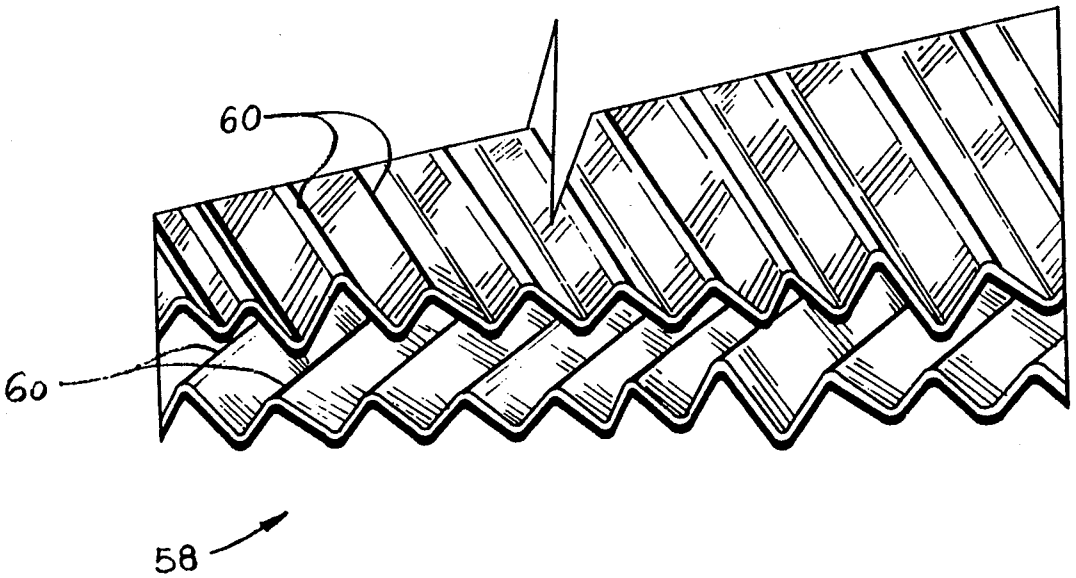
FIG. 8 is an enlarged perspective detail view of a second alternative embodiment.

The heat exchanger 10 is assembled having a single cell 20, or, in an alternative embodiment illustrated in FIG. 5, is assembled around a stack of cells 20. Two stacked cells 20 are shown isolated in FIG. 4, and as part of the assembled heat exchanger 10 in FIG. 5.

Turning now to FIG. 2, cells 20 have textured heat exchange surfaces 21 including embossments 32A, 32B, 34 formed in each top and bottom shell 24A, 24B, alternately extending outwardly (toward an adjacent cell 20 above or below) and inwardly (toward a corresponding embossment 34 within the cell 20). Outwardly facing embossments 32A, 32B are aligned with cooperating embossments 32A, 32B such that the embossments 32A, 32A or 32B, 32B abut, thus spacing a cell 20 apart from an adjacent cell 20. Mutual alignment of embossments 32A, 32B between adjacent cells 20 is best shown in FIG. 4. Outwardly extending embossments 32A, 32B are alternately substantially conical (32A) and substantially tetrahedral (32B).

Figure 3:
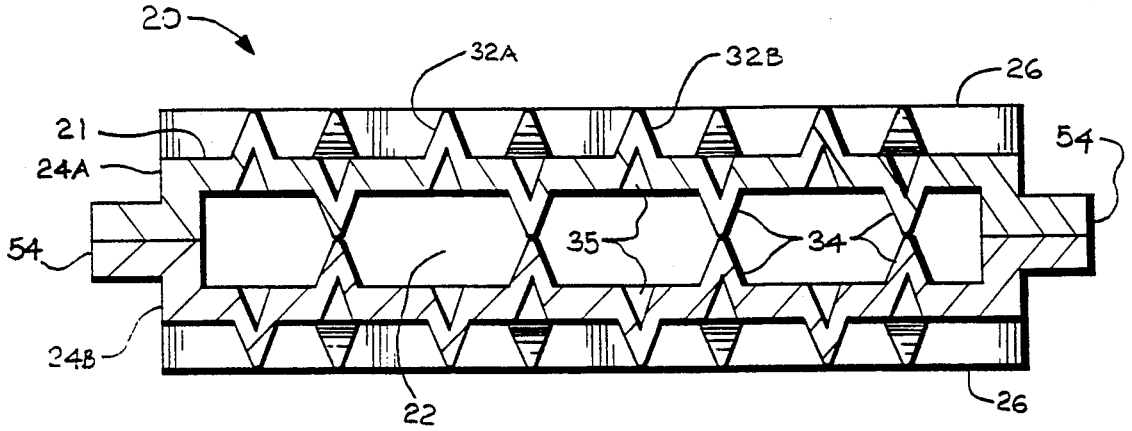
FIG. 3 is a cross sectional view of a single cell taken along line 3—3 of FIG. 2.

Inwardly facing embossments 34, best seen in FIG. 3, are only conical, and are aligned with cooperating embossments 34, also in abutted fashion, so that each shell 24A or 24B mutually supports its opposing shell 24A or 24B such that the cell 20 is prevented from collapsing, as due to possible pressure surges within the piping system P.

An appropriate number of cells 20 is selected to provide desired fluid handling capacity. These cells 20 are surrounded by, and therefore enclosed within, four headers 12, 14, 16, 18 and top and bottom plates 36, 38. Top and bottom cover plates 36, 38 are shown in FIG. 1; headers 12, 14, 16, 18 are shown assembled in FIG. 1 and are shown separated from other components in FIG. 5. A distribution header 12 distributes a first fluid A to flow throughout the heat exchanger 10 to a collection header 14. It is to be understood that headers 12, 14 are interchangeable with one another, and headers 16, 18 are similarly interchangeable; designation as "distribution" or "collection" is merely for convenience in designating flow direction.

Figure 6:
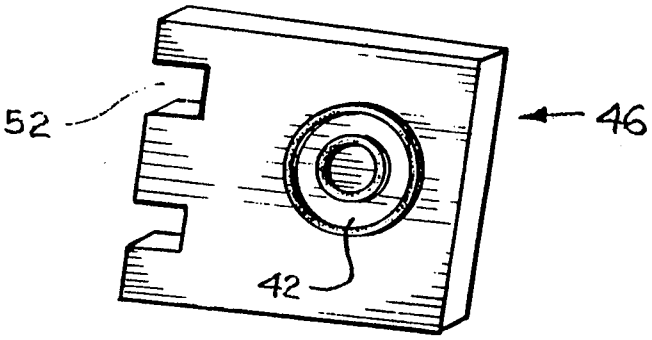
FIG. 6 is an enlarged perspective detail view of a header end panel.

Headers 12, 14 are preformed to have a narrow endplate 40 having a knockout 42, then widening to cooperate with the wide mouths 26 of the stacked cells 20. Knockouts 42, shown in FIG. 6, are frangible, annular or round members sealing an orifice 44 defined in the endplate 40. Removal of an appropriate knockout 42 leaves an orifice 44 of similar diameter to a pipe P to be connected to the heat exchanger 10, thereby facilitating attachment of the pipe P to the heat exchanger 10.

A second distribution header 16 distributes a second fluid B, of a different temperature, to flow throughout the heat exchanger 10 to a second collection header 18. The second distribution header 16 is formed by joining two end panels 46, 48, one end panel 46 having a knockout 42, and a side plate 50. Slots 52 formed in the end panels 46, 48 allow interfitting of the end panels 46, 48 with cell flanges 54. The end panels 46, 48, side plate 50, and cell flanges 54 are joined, as by brazing or welding.

The first fluid A flows through the interior passage 22 within each cell 20, and is constrained to flow only within cells 20. The second fluid B flows around the exterior of each cell 20 in the space created by the spacing apart of adjacent cells 20, the second fluid B being constrained against entering the cells 20. The two fluid circuits A, B thereby flow in close proximity, fluid A within each cell 20, and fluid B around the exterior of each cell 20, the two circuits A, B being segregated as they flow from their respective distribution headers 12, 16 to their respective collection headers 14, 18.

Figure 7:
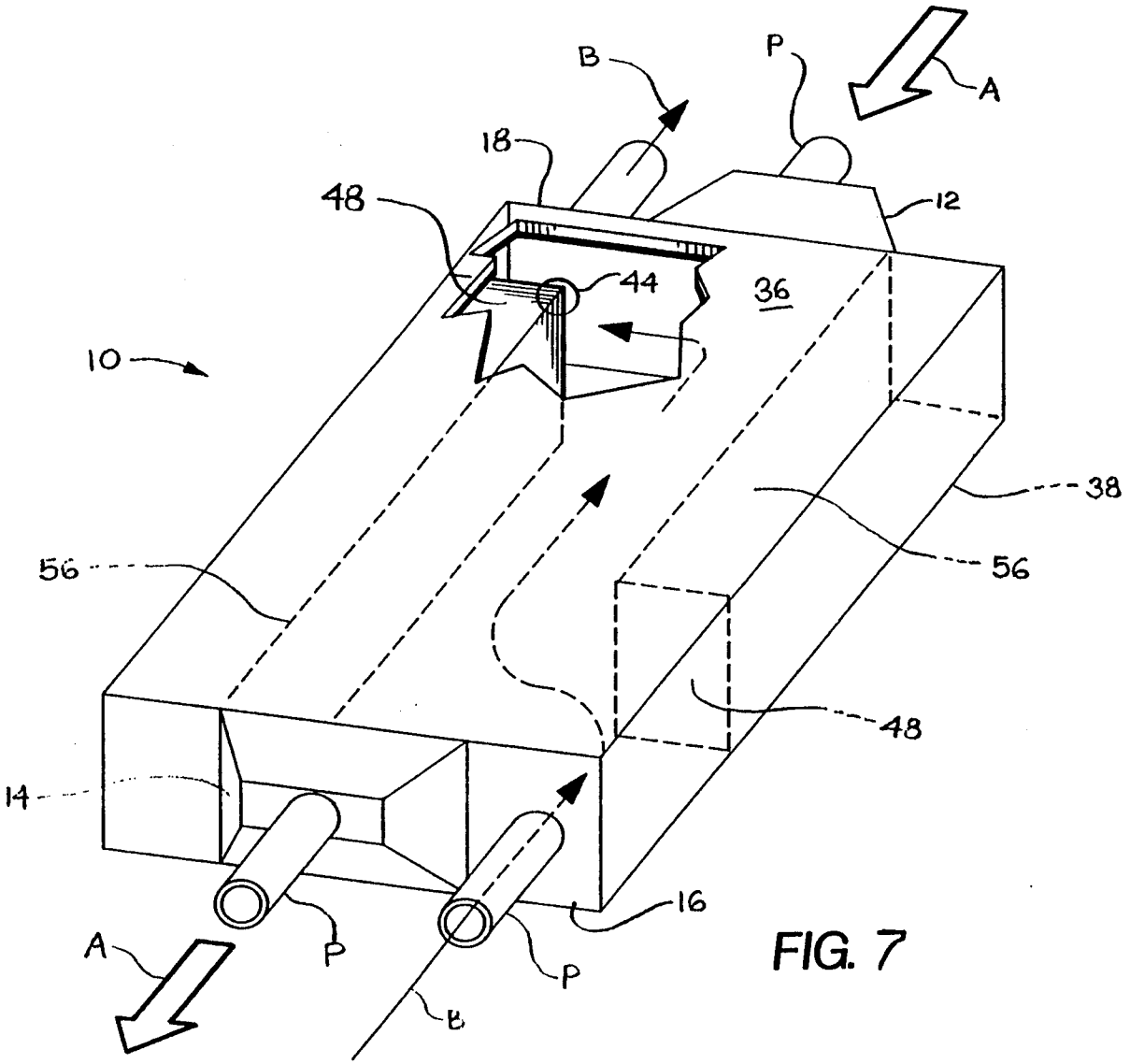
FIG. 7 is an isometric view of an alternative embodiment of the invention, partly broken away to reveal internal detail.

In an alternative embodiment shown in FIG. 7, a counterflow pattern is established by including two additional end panels 48 and two baffle walls 56. Fluid B, formerly flowing essentially normal to the flow of fluid A, is now constrained to flow parallel to but opposite fluid A.

Assembly of the heat exchanger 10 starts with attachment, as by soldering, of one shell 24A or 24B to another, the cells 20 forming joined mirror images so as to define a cell 20 open at both mouths 26 therebetween. A desired number of cells 20 is stacked, with the mouths 26 oriented similarly, so that fluid A enters all cells 20 from a common distribution header 12, and is discharged to a common collection header 14.

The respective headers 12, 14, 16, 18 are then attached, the headers 12, 14, 16, 18 being selected to be compatible in dimension with the height of the stack of cells 20. Top and bottom plates 36, 38 are attached, thus enclosing the heat exchanger 10 in fluidtight manner. As seen in FIG. 5, header side plates 50 are slotted to cooperate with cell flanges 54. Knockouts 42 are removed from the headers 12, 14, 16, 18, and four pipes P from a piping system are suitably connected. The resultant assembled heat exchanger 10 is now properly enclosed, sealed, and is further supported by the four pipes P to which it is attached.

It is an important feature of the present invention that the stacked cells 20 present parallel and perpendicular outer boundaries, and that each of the four headers 12, 14, 16, 18 covers and seals one complete boundary of the heat exchanger 10. In this manner, four of the six boundaries, or sides, are sealed by headers 12, 14, 16, 18, so that enclosing the heat exchanger 10 and retaining and segregating the two fluids A, B is accomplished by the addition of only two further members, these members being top and bottom cover plates 36, 38. This construction provides a mechanically solid and compact configuration.

The embossments 32A, 32B, 34 formed in the shells 24A or 24B are alternately essentially conical or essentially tetrahedral, and have an open remaining side 35. Open sides 35 are best seen in FIGS. 3 and 4. These configurations, in particular as they combine with respective aligned embossments 32A, 32B, 34 of other cells 20 or of shells 24A or 24B, promote turbulence in the fluid flows A, B. This turbulence strips away a boundary stratum of fluid (not shown) which is defined along each shell surface, so that contact of the fluid with the solid surface is more intimate, heat thus transferring more quickly. This is accomplished without imposing an undue frictional impediment to fluid flow, and without utilizing a construction requiring significantly more heat exchange plate mass, as seen in '391.

In another alternate embodiment, a textured heat exchange surface 21 promoting turbulence is provided by fluting 58, the fluting 58 of a top shell 24A running at an angle or bias to the fluting 58 of a bottom shell 24B. Fluting 58,58 between adjacent cells 20 is also run in biased fashion. Each ridge 60 formed in the fluting 58 will contact each bias oriented ridge 60 as it crosses the biased fluting 58, thus providing plural points of support to each individual ridge 60. Support opposing cell collapse and spacing apart of adjacent cells 20 are thus provided, as with the arrangement utilizing embossments 32A, 32B, 34.

The heat exchanger 10 is thus readily field assembled, and offers versatility in size and capacity. The compact size and efficient heat exchange surfaces assure sufficiently light weight construction as to be supported on the piping system P without requiring additional support structure. The cells 20 are sufficiently deep, and cells 20 are sufficiently spaced apart as not to cause undue static pressure losses therein.

It is to be understood that the present invention is not limited to the embodiments described above, but encompasses any and all embodiments within the scope of the following claims.

I claim:

1. A modular heat exchanger comprising at least one two part cell having top and bottom shells;

each of said shells having a textured heat exchange surface;

at least one top flange being formed on said top shell;

at least one bottom flange being formed on said bottom shell;

each top shell meeting a corresponding bottom shell along said at least one top flange and said at least one bottom flange;

a bottom edge of said at least one top flange meeting a top edge of said at least one bottom flange;

said flanges having a first thickness in a given direction, said shells defining a second thickness in said given direction, said first thickness being substantially less than said second thickness; and closure means enclosing said at least one two part cell, said closure means comprising two distribution headers and two collection headers located along opposed sides of said at least one two part cell, and two cover plates, whereby fluid capacity of said heat exchanger is determined by the number of said cells employed in assembly thereof.

2. The heat exchanger according to claim 1, each of said textured heat exchange surfaces having embossments formed therein;

said embossments in any one sheet extending alternately and variably upwardly and downwardly from said one sheet, whereby each of said embossments defines a depression on a first side of one of said textured heat exchange surfaces and simultaneously forming a projection on a second side thereof, said embossments of one of said cells aligning with said embossments of a second of said cells, whereby opposing embossments interfere thus spacing said cells apart when said cells are stacked, said embossments extending variably inwardly and outwardly from each of said textured heat exchange surfaces.

3. The heat exchanger according to claim 2, said distribution and collection headers having at least one panel including a knockout defining an orifice upon removal thereof, whereby an orifice of desired location and diameter is provided, thus enabling a pipe to be readily located on and attached thereto.

4. The heat exchanger according to claim 2, said embossments being of predetermined configuration, selected ones of said embossments being substantially conical and selected others of said embossments being substantially tetrahedral, all of said embossments being open on one side.

5. The heat exchanger according to claim 2, at least one of said headers comprising panels slotted to cooperate with said at least one cell flange.

6. The heat exchanger according to claim 2, said stacked cells having parallel and perpendicular outer sides, said headers being connected to and entirely covering four of said parallel and perpendicular outer sides, whereby enclosure of said cells is completed by the addition of said two and bottom cover plates.

* * * * *